US009518421B2

(12) United States Patent
Cushwa, Jr. et al.

(10) Patent No.: US 9,518,421 B2
(45) Date of Patent: Dec. 13, 2016

(54) SAFETY DOOR BARRICADE

(71) Applicant: National School Control Systems, LLC, Hudson, OH (US)

(72) Inventors: William W. Cushwa, Jr., Hudson, OH (US); David A. Soulsby, Silver Lake, OH (US)

(73) Assignee: National School Control Systems, LLC, Hudson, OH (US)

( * ) Notice: Subject to any disclaimer, the term of this patent is extended or adjusted under 35 U.S.C. 154(b) by 120 days.

(21) Appl. No.: 14/107,339

(22) Filed: Dec. 16, 2013

(65) Prior Publication Data

US 2014/0312634 A1 Oct. 23, 2014

Related U.S. Application Data

(60) Provisional application No. 61/814,618, filed on Apr. 22, 2013.

(51) Int. Cl.

| | |
|---|---|
| ***E05C 17/54*** | (2006.01) |
| ***E05C 19/18*** | (2006.01) |
| ***E06B 5/10*** | (2006.01) |
| ***E06B 9/02*** | (2006.01) |

(52) U.S. Cl.

CPC ..... *E06B 5/10* (2013.01); *E05C 19/182* (2013.01); *E05C 19/184* (2013.01); *E06B 9/02* (2013.01); *Y10T 292/68* (2015.04)

(58) Field of Classification Search

CPC ..... E05C 17/44; E05C 17/46; E05C 17/48; E05C 17/54; E05C 17/047; E05C 19/1825; E05C 19/184; E05C 19/003; E05C 19/18; E05C 19/188; E05C 19/182; E06B 5/10; E06B 5/11; E06B 9/02

USPC ..... 292/288, 289, 291–293, 295, 296, 342, 292/343, DIG. 15, 338, 339, 294; 16/82

See application file for complete search history.

(56) References Cited

U.S. PATENT DOCUMENTS

| | | | | |
|---|---|---|---|---|
| 517,456 | A | 4/1894 | Henry | |
| 1,036,890 | A | 8/1912 | Ogden | |
| 1,037,439 | A | 9/1912 | Coffin | |
| 1,830,296 | A * | 11/1931 | Siino | E05C 17/54 292/338 |
| 1,876,881 | A | 9/1932 | Durant | |
| 1,989,536 | A * | 1/1935 | Traum | E05C 17/54 211/43 |
| 2,553,732 | A | 5/1951 | Young | |
| 2,568,477 | A | 9/1951 | Westlund | |
| 3,863,968 | A | 2/1975 | Fraser | |
| 4,198,088 | A * | 4/1980 | Tochihara | E05C 19/18 292/288 |

(Continued)

*Primary Examiner* — Alyson M Merlino

(74) *Attorney, Agent, or Firm* — Lorri W. Cooper; Medley, Behrens & Lewis, LLC

(57) ABSTRACT

A door barricade includes a base member and a securing mechanism. The base member has a size that permits it to be positioned under a door, with a first upwardly extending portion positioned on the base member and a second upwardly extending portion positioned on the base member. The first and second upwardly extending portions are spaced a distance from one another that is greater than or equal to a width of a door. The securing mechanism is coupled to the base member for mating with a floor. The base member and the securing member together serve to barricade a door such that the door will not move even upon the application of significant force when the securing mechanism is fixedly coupled to a floor.

2 Claims, 16 Drawing Sheets

(56) References Cited

U.S. PATENT DOCUMENTS

| | | | | | |
|---|---|---|---|---|---|
| 4,585,259 | A * | 4/1986 | Vidas | E05C 17/54 | 16/82 |
| 4,910,817 | A | 3/1990 | Kita | | |
| 5,383,254 | A * | 1/1995 | Wigley, Sr. | E05B 65/0894 | 16/82 |
| 5,454,143 | A * | 10/1995 | Wigley, Sr. | E05B 65/0894 | 16/82 |
| 5,474,343 | A * | 12/1995 | Ledbetter | E05C 19/003 | 292/259 R |
| 6,345,849 | B1 * | 2/2002 | Yen | E05C 17/54 | 292/292 |
| 6,378,917 | B1 * | 4/2002 | Jones | E05C 19/184 | 16/82 |
| 7,637,130 | B2 | 12/2009 | Carr | | |
| 7,651,140 | B2 * | 1/2010 | Leggio | E05B 63/0004 | 16/82 |
| 7,661,733 | B1 | 2/2010 | Angel | | |
| 7,770,420 | B2 | 8/2010 | Carr | | |
| 8,177,267 | B2 | 5/2012 | Kuehn | | |
| 8,764,074 | B2 | 7/2014 | Ploskunak | | |
| 8,899,639 | B2 | 12/2014 | Ploskunak | | |
| 2008/0263958 | A1 | 10/2008 | Edson | | |
| 2009/0058104 | A1 | 3/2009 | Huang | | |
| 2009/0100884 | A1 | 4/2009 | Carr | | |
| 2009/0102205 | A1 | 4/2009 | Carr | | |
| 2009/0322106 | A1 | 12/2009 | Wood | | |
| 2010/0102573 | A1 | 4/2010 | Rancatore | | |
| 2010/0207402 | A1 | 8/2010 | Ploskunak | | |
| 2011/0011137 | A1 * | 1/2011 | Frankel | E05C 19/184 | 70/93 |
| 2011/0187131 | A1 | 8/2011 | Ploskunak | | |
| 2012/0292929 | A1 | 11/2012 | Ploskunak | | |
| 2014/0300114 | A1 | 10/2014 | Atkinson, Jr. | | |
| 2014/0306464 | A1 | 10/2014 | Lowe | | |
| 2014/0327249 | A1 | 11/2014 | Snyder | | |

* cited by examiner

SAFETY DOOR BARRICADE

FIELD

The present invention concerns a door safety stop or barricade that can be installed easily and that can deter the opening and closing of a door. The present invention is particularly advantageous in an emergency situation where it is necessary to barricade a door from inside a room.

BACKGROUND

Recent public events have brought to light the safety of students in classrooms. Schools are presently investigating techniques for deterring intruder's from entering a school and from being able to enter a classroom. Time is the key factor in the development of strategies for dealing with an intruder. Responders can often take 10 or more minutes to respond in an emergency situation. During this time, schools go into "lock down." This initial 8-10 minutes, when police have not yet arrived, can be critical. Thus, a quick and effective technique for barricading classroom doors is needed in order to allow time for police response and to protect the occupants of the classroom.

There are many types of doors in school buildings. Depending on the age and era of the school, some doors swing inwardly and some doors swing outwardly. In addition, some doors are double doors that open in the middle of two doors, with each door swinging inwardly or outwardly. Many school buildings, due to fire safety codes, do not permit door locks on the interior of a classroom. The doors may only lock with the use of a key on the exterior of the classroom knob. In an intruder situation, it is often undesirable to enter a hallway in order to lock a door knob. In addition, a nervous teacher fumbling with keys may have a hard time locking the lock.

Some classrooms have windows in a wall or in the door. In the case where the doorknob has a locking mechanism, it can often be thwarted by the intruder breaking the window and reaching in and unlocking the knob.

One device is known that utilizes a rod that extends under a door and can be rotated upwardly once under the door in order to block the movement of the door. This device, described in U.S. Pat. No. 8,251,412, is attached to a door jamb with a screw or similar securing mechanism. Thus, it includes a bracket that accepts a screw or pin and a hole is positioned in the door jamb adjacent the door. One problem with this design is that a door jamb can oftentimes be easily kicked in. Thus, an intruder with significant strength may be able to kick in the door by using force. In essence, the device of the '412 patent is similar to a lock, since locks will typically be secured in a door jamb.

DETAILED DESCRIPTION

Figure 1:
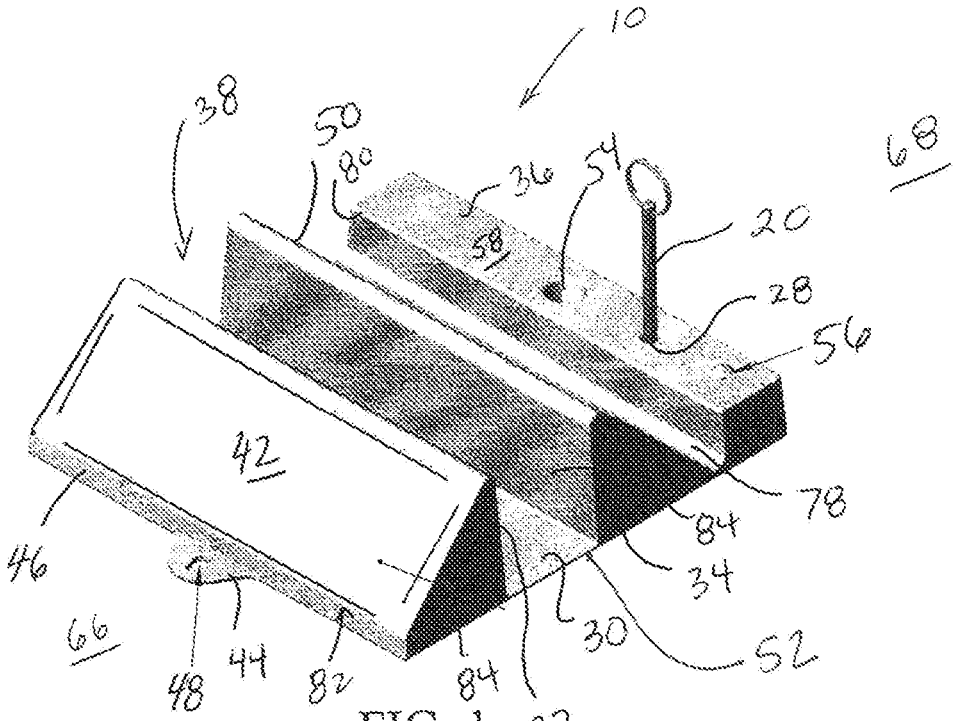
FIG. 1 is a perspective view of an example barricade device showing a pin in a stowed position.

An example barricade device 10 provides a barricade that can be used with any type of door 12, such as one that swings inwardly or outwardly, or with a double or a single door. The example device 10 may either be permanently installed or may be temporarily positioned near a door 12 so that, when it is needed, it may be quickly and easily installed on a door of a building, such as a classroom, office building, or home. For example, the example barricade device 10 may be hung on a hook 14 near the door 12 so that when it's needed, it can be removed from the hook 14 and positioned under the door 12.

The example barricade device 10 is easy to install. The device 10 can be used on any type of door 12, including a classroom door, an office door, a restroom door, a door without a lock, an inwardly swinging door, or an outwardly swinging door, among other types of doors. The example device 10 may be used to secure double doors, such as those that may be encountered in a library, chapel, or conference room setting. The example device 10 can be deployed immediately with simple pre-installation of a receptacle 16 in the floor 18, such as a channel or hole, for receiving a securing member 20, such as a pin. No door frame 22 modifications are necessary. The example device 10 relies on the floor 18 or another surface for providing strength to the device 10, rather than a door frame 22.

The example barricade device 10 may include a portion that can alert authorities that a room is secured. This may allow authorities to more quickly search a building for an intruder and to divert resources to locations where an active intruder may be. This may further help to reduce response time to an appropriate portion of a building.

The example barricade device 10 is positioned on the floor 18. In some instances, where a door 12 includes a window or is positioned next to a window, the location of the example device 10 will make it difficult for an intruder to remove the device 10 and open the door 12. The examples depicted herein show the example device 10 positioned near the center of the bottom of the door 12. However, the device 10 could be positioned at other locations on the door 12, such as closer to the hinges 24 of the door 12 or closer to the door knob 26 of the door 12.

Referring to the figures, FIGS. 1-11 depict a first example barricade device 10 and FIGS. 12-16 depict a second example barricade device 10. The difference between the device 10 of FIGS. 1-11 and 12-16 is that the base thickness T1 in FIGS. 1-11 is thinner than the base thickness T1 in FIGS. 12-16.

Figure 2:
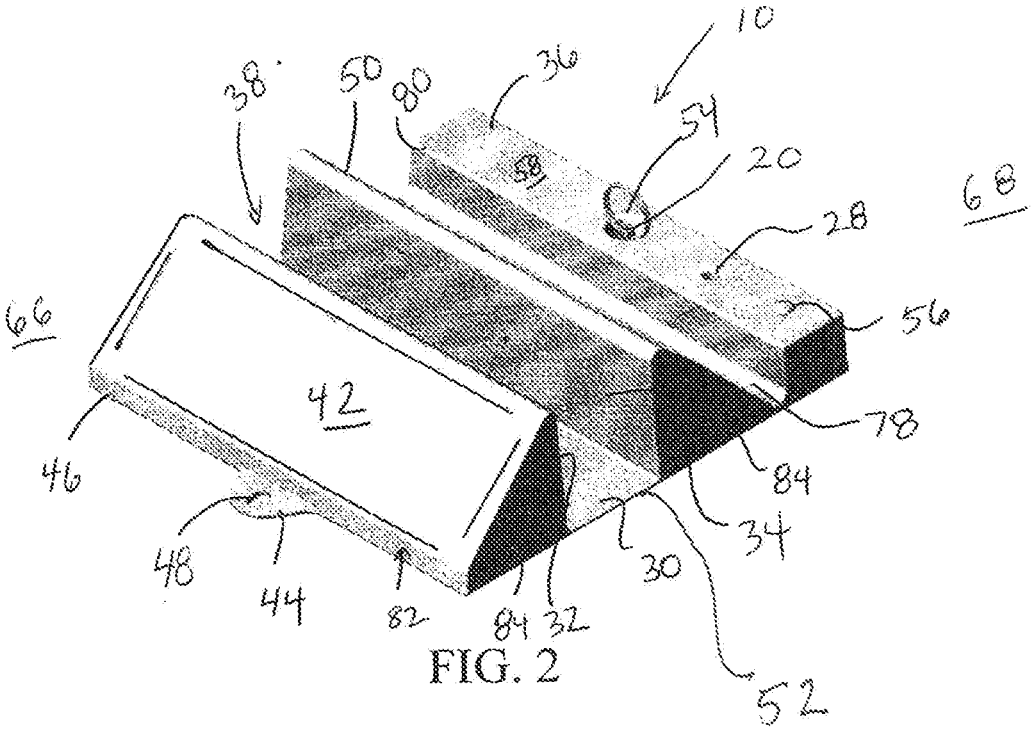
FIG. 2 is a perspective view of an example barricade device showing a pin in an engaged position.

Referring to FIGS. 1-11, FIG. 1 depicts an example barricade device 10 showing a securing mechanism 20 in the form of a pin in a stowing recess 28. FIG. 2 is the same example barricade device 10 with the pin 20 in a secured position where the pin 20 is installed in a channel in the example device 10 and extended into the floor 18. The example device 10 includes a base 30, a first upwardly extending member 32, a second upwardly extending member 34, a fortified end portion 36, and a recess 38 for receiving the bottom 40 of a door 12.

The first upwardly extending portion 32 is shown to be a vertical wall coupled to an angled outwardly facing surface 42. The outwardly facing surface 42 is a label surface upon which a label can be applied, if desired. A tab 44 is coupled to the outer end 46 of the angled outer surface 42. The tab 44 has an opening 48 and can be used for receiving a nail or hook 14 upon which the device 10 can be stored during non-use. The second upwardly extending member 34 is shown to be a vertical wall positioned on the opposite side of the recess 38. The second upwardly extending member 34 is coupled to a second outwardly angled surface 50 that extends downwardly to the bottom 52 of the device. The second outwardly angled surface 50 is a label surface that can be used for applying a label, if desired. The fortified portion 36 is a substantially rectangular 52 member that is coupled to the second outwardly angled surface 50 in the vicinity of the bottom of the device 10. The fortified portion 36 may be fortified with additional strength, such as by making the portion 36 out of a solid material, if desired, among other known methods for fortification. The fortified portion 36 is the member into which a pin 20 is inserted in order to couple the device 10 to a floor 18 of a building. The fortified portion 36 may include a receptacle 28 for storing a pin as well as a channel 54 that extends through the fortified portion 36 for receiving the pin 20 and coupling the device 10 to a hole 16 in the floor 18.

FIGS. 1 and 2 also show a rivet 56 positioned on a top surface 58 of the fortified end portion 36. This rivet 56 is positioned adjacent the stowing receptacle 28 for the pin 20. The rivet 56 may be used for attaching a lanyard (not shown) to couple the pin 20 to the device 10 so that the pin 20 is not lost over time. The lanyard could be a chain, cord, or other device, with one end secured to the rivet 56 and the other end secured to the pin 20, such as the ring on the pin.

Figure 3:
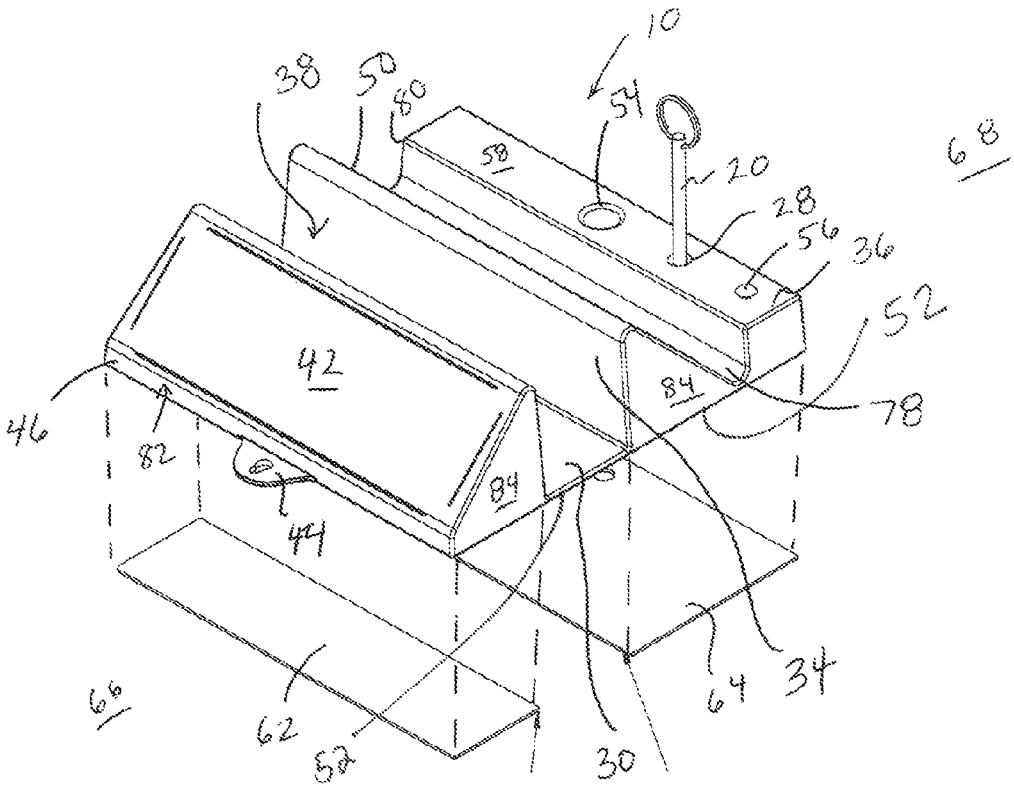
FIG. 3 is an exploded perspective view of an example barricade device showing base plates of the device separated from the top of the device.
Figure 4:
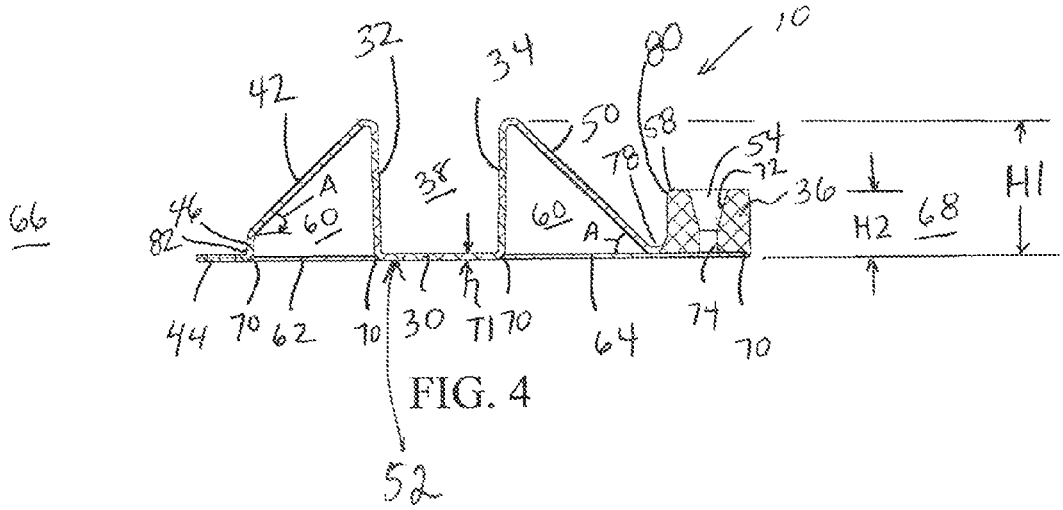
FIG. 4 is a cross-sectional view of an example barricade device taken along line 4-4 of FIG. 3.

FIGS. 3 and 4 show how the bottom 52 of the device 10 is finished. As shown in FIG. 4, the first and second upwardly extending portions 32, 34 and their associated angled walls 42, 50 form a generally, substantially triangular recess 60 in the interior of the device 10. The bottom 52 of the device 10 may be enclosed using plates 62, 64 that are coupled to the bottom 52 of the device 10. The device 10 has a base 30 that is provided in the recess 38 between the first and second upwardly extending members 32, 34. This base 30 has a thickness so that it can slide under most, if not all doors 12 while still permitting the door to be closed. Base plates 62, 64 may be coupled to the device 10 in order to enclose the bottom 52 and to strengthen the device 10. The base plates 62, 64 are planar and may be coupled using welding, an adhesive, or any other known attachment technique. Two base plates 62, 64 are shown, with one base plate 62 being coupled to the outer door side 66 of the device 10 and another base place 64 being coupled to the inner door side 68 of the device 10.

FIG. 4 shows a cross-sectional view of the barricade device 10. Triangular interior sections 60 are enclosed by the upwardly extending portions 32, 34 and the base plates 62, 64 and base 30. Due to the geometry of the device and the strength of the material utilized, it is not necessary that the device be solid, although the device could be solid if desired. The base plates 62, 64 along with the base 30 at the bottom of the recess 38 define a bottom, substantially planar surface. The base plates 62, 64 may seat in predefined grooves 70 disposed in the bottom 52 of the device 10. The fortified end portion or member 36 has a channel 54 defined therethrough from the top surface 58 to the bottom surface 52 thereof. The channel 54 may have a portion 72 that is conical, or can be entirely conical is desired, to guide the pin 20 downwardly, with the larger opening of the conical portion being at the top surface 58. Part of the channel 74 may be cylindrical and part of the channel 72 may be conical, if desired. Other geometries may alternatively be utilized as long as they permit the pin 20 to be inserted through the fortified end portion 36 into an opening 76 in a non-door surface, such as the floor 18. In this example device 10, the base plates 62, 64 are substantially co-planar with the base 30 in the recess 38.

Figure 5:
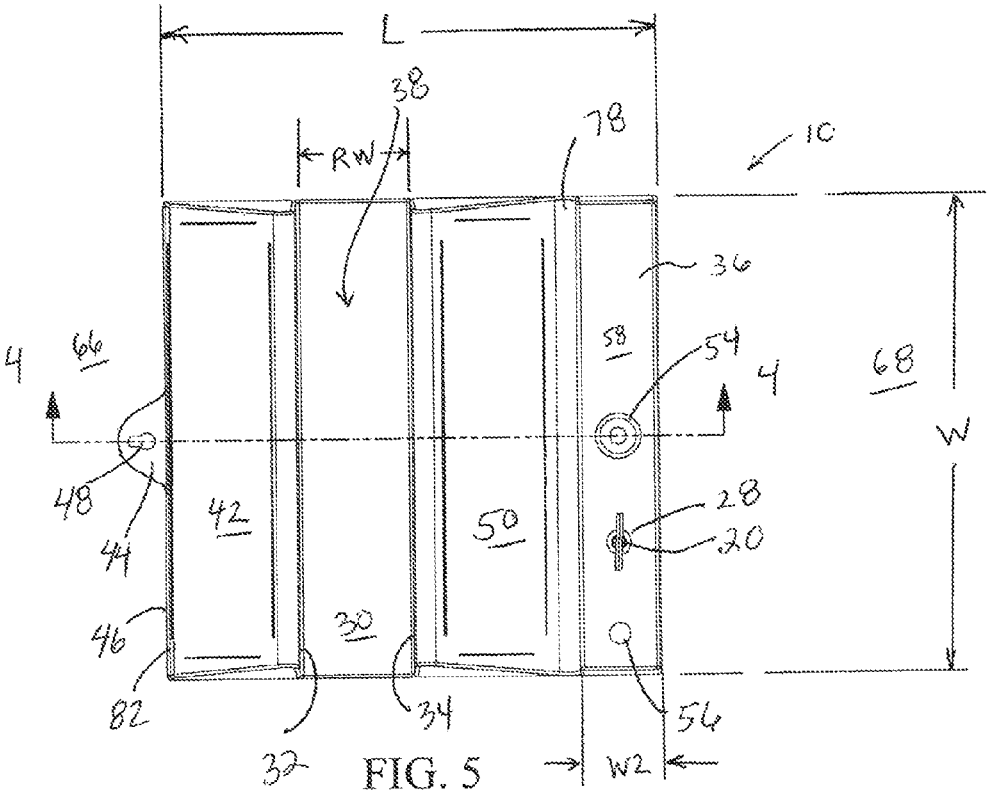
FIG. 5 is a top view of the example barricade device of FIG. 1.
Figure 6:
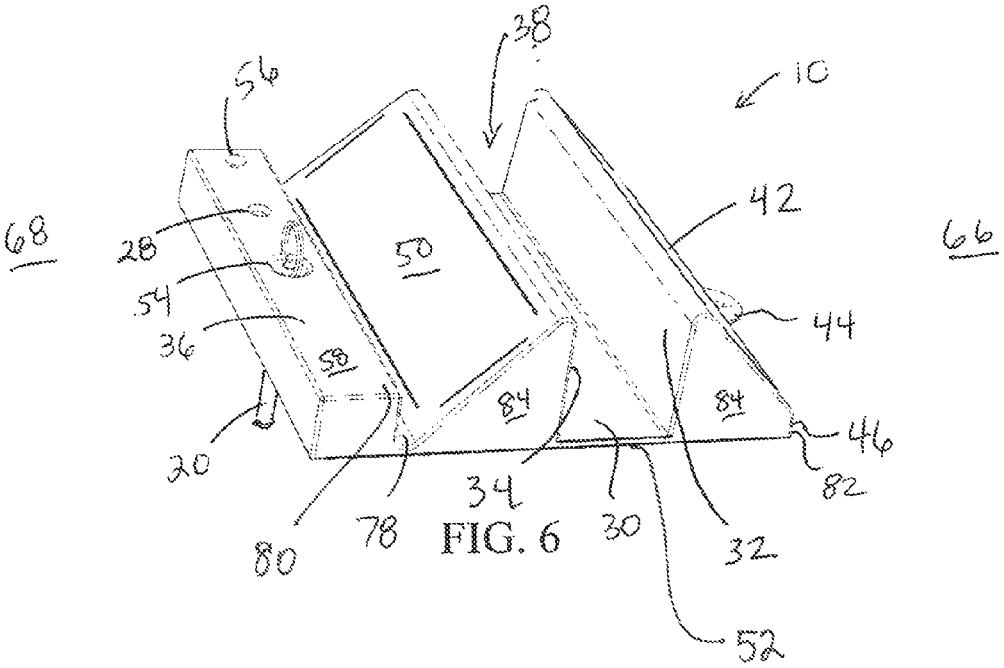
FIG. 6 is an inner end perspective view of an example barricade device of FIG. 2.

FIG. 5 depicts the device 10 in top view showing the fortified end portion 36 on the right side of the view and the hanging tab 44 on the left side of the view. The hole 48 in the hanging tab 44 is key hole shaped, but could be round or another shape. The tab 44 is designed for hanging the device 10 on a surface, such as a wall, when not in use. The pin 20 is depicted in a stored position.

FIGS. 6-9 and 11 are similar to FIG. 5, but show the device 10 with the pin 20 in an installed position, with the pin being visible extending from the channel 54 in the fortified end portion 36. In use, the pin 20 extends into an opening 76 defined in the floor 18 or another surface. The device 10 shown has a width so that it extends along part of the width of the door 12. The device 10 could have a larger width or a smaller width. In one embodiment, discussed later, the device has a width that is significantly smaller than that shown in FIGS. 1-11.

Figure 7:
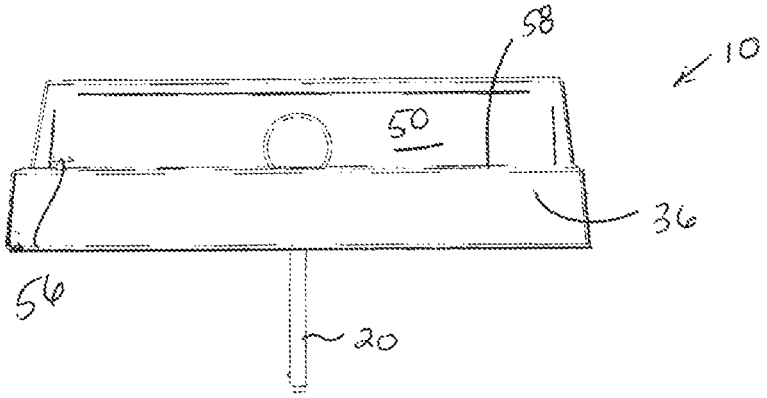
FIG. 7 is an end view from the inner end of the example barricade device of FIG. 2.
Figure 8:
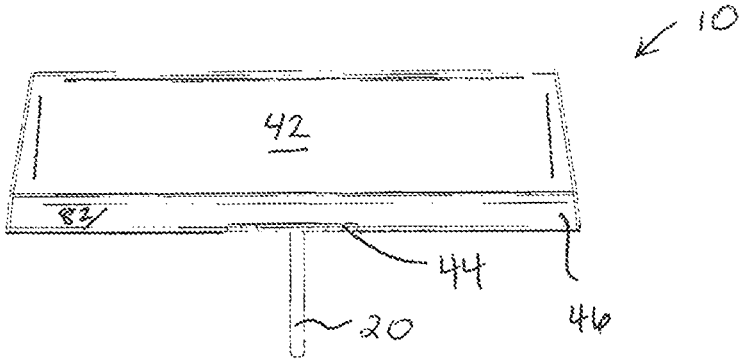
FIG. 8 is an end view from the outer end of the example barricade device of FIG. 2.
Figure 9:
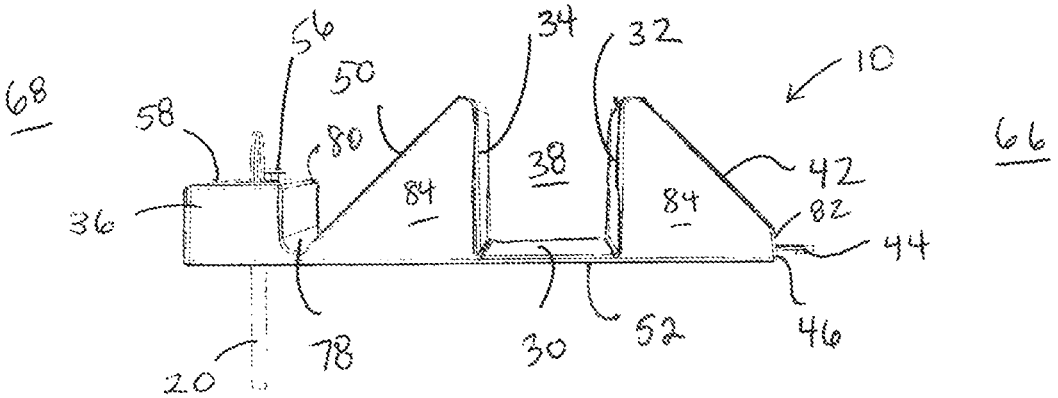
FIG. 9 is a side perspective view of the example barricade device of FIG. 2.

FIGS. 7-9 show how the height H1 of the first and second upstanding members 32, 34 are substantially the same and that the height H2 of the fortified end portion 36 is lower than the height of the upwardly extending members 32, 34. The height H1 of the first and second upwardly extending members 32, 34 is not required to be the same. There may be instances where it is desirable for one to be taller than the other. In addition, the height H2 of the fortified end portion 36 is shorter than the height H1 of the upwardly extending members 32, 34. However, the fortified end portion 36 could have the same height as the upwardly extending members 32, 34, if desired. A U-shaped channel 78 is shown positioned between the upwardly extending members 32, 34 on the inner side 68 of the door 12 and the fortified end portion 36. The position of the U-shaped channel 78 provides a thinned section of the device that is spaced from the recess 38. This U-shaped channel 78 could be replaced with a different type of recess. Alternatively, the angled surface 50 of the upwardly extending member 32, 34 could extend directly to the top corner 80 of the fortified portion 36, if desired. In some cases, the interior of the triangular recesses 60 could be solid.

The angled surfaces 42, 50 of the upwardly extending members 32, 34 are shown as being at the same, but opposite angles A. Other angles A could be used depending upon the strength needed and other factors. The outer side 66 edge 82 of the angled surface 42 transitions from angled to vertical. Alternatively, this surface 82 could be angled until it meets the tab 44. The fortified portion 36 is shown as having a rectangular cross-section. It could have other shapes, if desired.

FIG. 9 also shows that the outer sides 84 of the device 10 are enclosed. The sides 84 are enclosed by molding the material in this manner, or by adding side plates, if needed. Alternatively, the outer sides could be left open such that the triangular recesses 60 are open.

Figure 10:
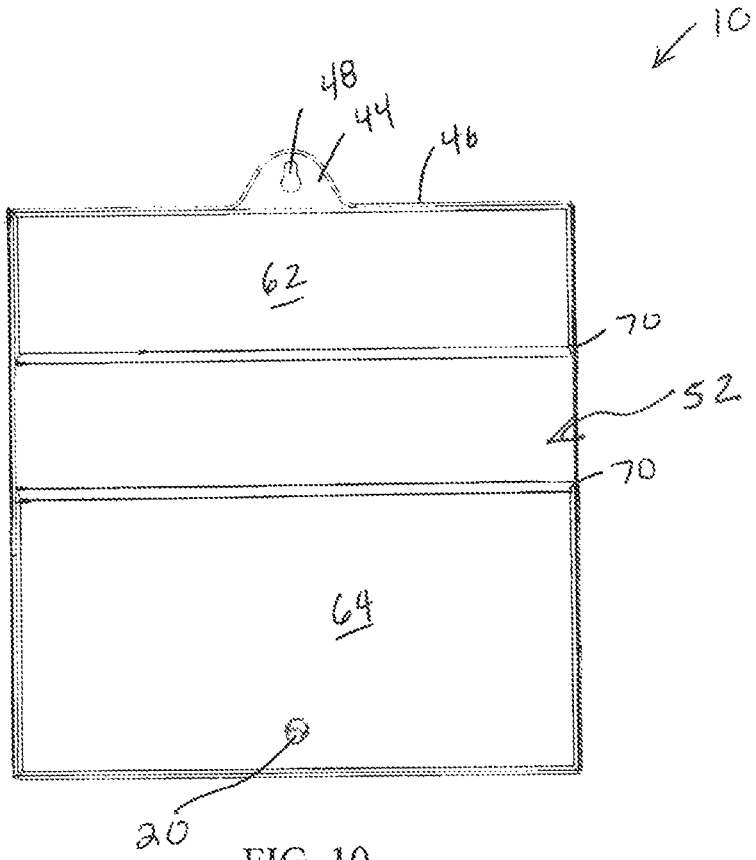
FIG. 10 is a bottom view of the example barricade device of FIG. 2.
Figure 11:
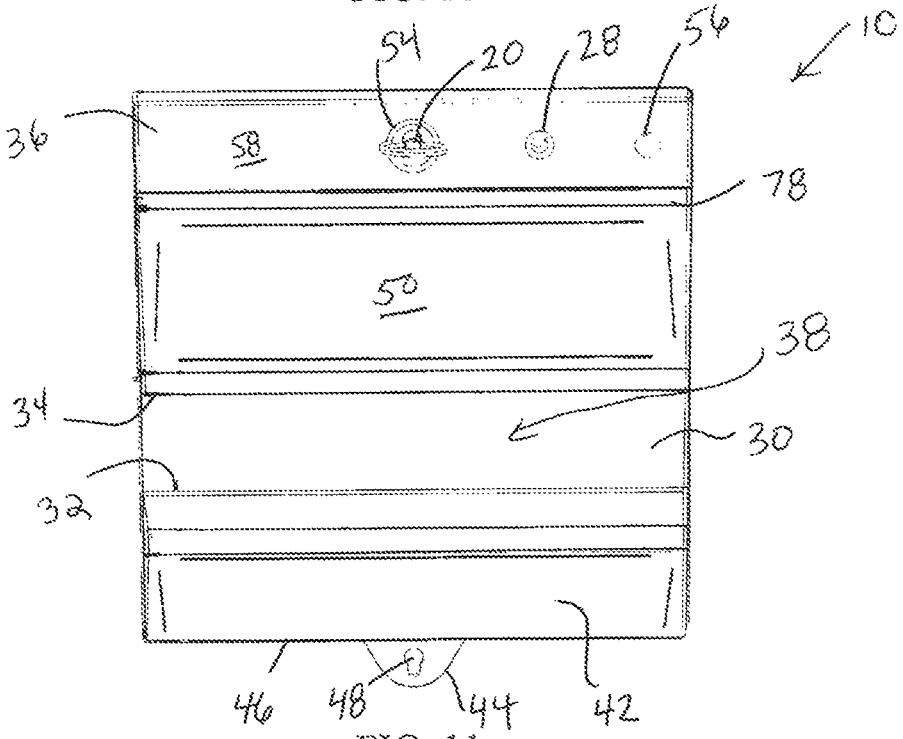
FIG. 11 is a top view of the example barricade device of FIG. 2.

FIG. 10 shows the bottom 52 of the device after the base plates 62, 64 have been installed. As discussed above, two plates 62, 64 are shown positioned under the device 10. Both plates 62, 64 are rectangular and have a thickness such that the bottom 52 of the device 10 is substantially planar when the plates 62, 64 are installed. Both plates 62, 64 have substantially the same width, but the outer side 66 plate 62 is shorter in length than the inner side 68 base plate 64. The inner side plate 64 covers the bottom of both the triangular recess 60 and the fortified end portion 36. If desired, a different type of material may be utilized for the base plates 62, 64 than for the rest of the device. For example, a different type of plastic could be used than the type of plastic used for the remainder of the device 10. Alternatively, a different type of material altogether could be used, like metal instead of plastic. For example, a stronger material could be used for the base plates 62, 64 than for the remainder of the device, as long as the overall device 10 can withstand forces necessary to barricade a door in an emergency situation. A typically pulling/pushing force that is considered is one of about 4000 lbs. However, an average person can generate only about 1000 lbs. of force.

FIGS. 12-16 depict an example device 10 that is similar to the device 10 shown in FIGS. 1-11, except the device 10 in FIGS. 12-16 has a thicker base 30. In particular, as shown best in FIGS. 14 and 16, in this example, the base plate 86 covers the entire bottom 52, except for a perimeter of the bottom 52 that defines a channel 54 into which the base plate 86 seats. Alternatively, the base plate 86 could cover the entire bottom 52, without the provision of a channel 54. The base plate 86 is planar and substantially flat. It has a thickness that is slightly less than the thickness of the base 30 in the recess 38 of the device 10. Overall, this alternative embodiment has a slightly greater thickness at the base 30 than the prior embodiment. As such, it must be confirmed that the device will fit under all doors 12 in a facility. If desired, the base 30 in the recess 38 could be defined only by the base plate 86, if desired, such that the inner side 68 and outer side 66 of the device 10 are separately molded and then adhered, welded, or otherwise attached to the base plate 86.

Figure 17:
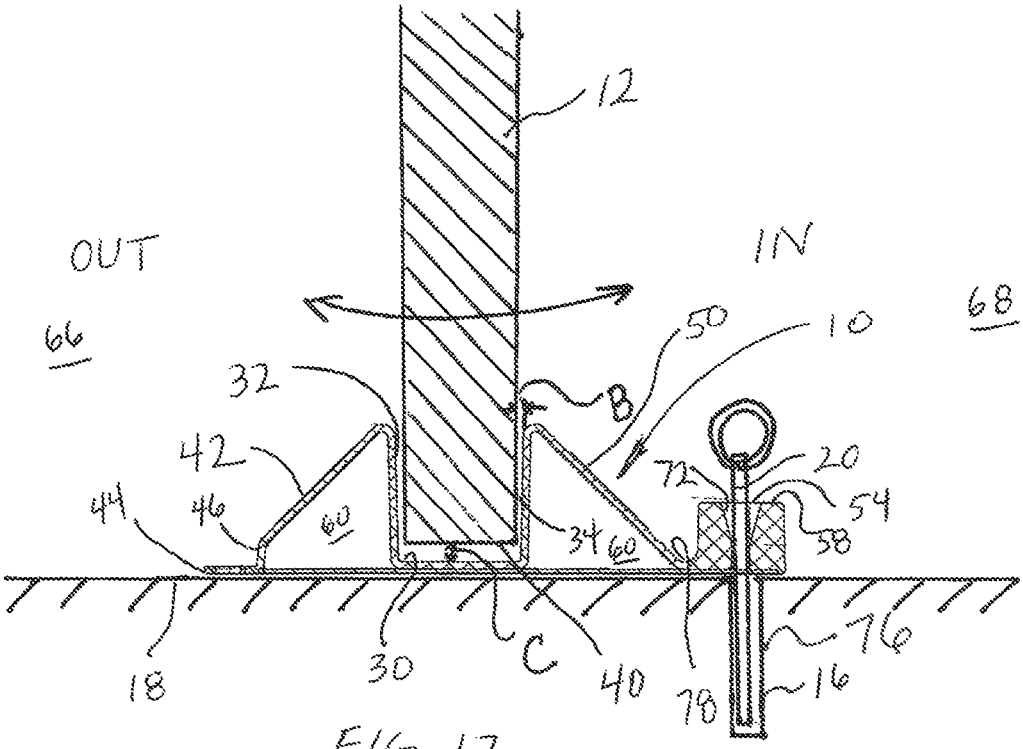
FIG. 17 is a cross-sectional view of the example barricade device of FIG. 12 installed under a door and with a pin engaged in a hole in the floor.

FIG. 17 shows the device 10 installed under a door 12. The door 12 in this example can either swing inwardly or outwardly and the device 10, once coupled to the floor 18, will deter movement of the door 12 either inwardly or outwardly. The door 12 seats in the recess 38 defined between the first and second upwardly extending members 32, 34. The tab 44 is positioned on the outer side 66 of the door and the fortified end portion 36 is positioned on the inner side 68 of the door. The first and second upwardly extending members 32, 34 abut the inner and outer side 68, 66 of the door 12. However, clearance B is provided between the door 12 and the upwardly extending members 32, 34. And clearance C is provided between the base 30 and the bottom of the door. An opening 76 is defined in the floor 18 and a pin 20 extends through the channel 54 defined in the fortified portion 36 and into the opening 76. The pin 20 helps to hold the device 10 in position in order to barricade the door 12 and should be of sufficient strength to withstand attempts to break down the door. As is evident the angled surfaces 42, 50 extend outwardly and upwardly so that they are visible to a user.

While not shown, a single upstanding member 32 or 34 may be used with a door 12 that only swings one way. If the door 12 in FIG. 17 could only swing inwardly, an inner upstanding member 34 could abut the door 12 and be connected to the fortified portion 36 to deter inward movement of the door 12. In this example, it would not be absolutely necessary to have an outer portion for the device, although, as will be explained in greater detail below, it may be desirable to include an outer portion even though not needed to deter movement of the door 12.

If the door in FIG. 17 could only swing outwardly, then an outer upstanding member 32 could abut the door 12 and a base plate 86 could extend under the door to a fortified portion 36, so that the inner upstanding member 34 would not be absolutely required. This may permit the length of the device to be shortened so that only a fortified portion 36 is provided on the inner door side 68, or a slightly longer fortified portion 36 is used along with a pin 20. The inner side 68 of the device 10 is always inside the room.

Figure 18:
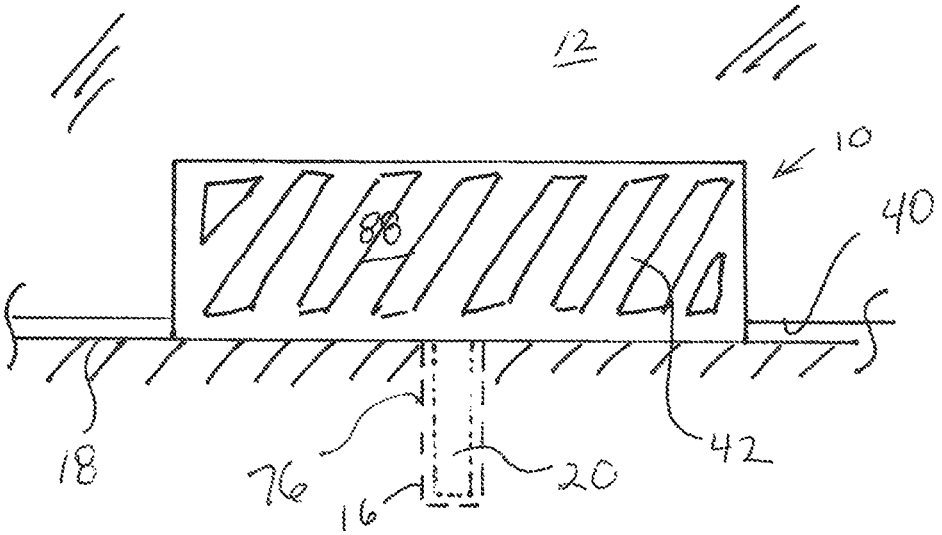
FIG. 18 is an outer view, e.g., from outside a classroom, of the device of FIG. 12 installed under a door with a pin engaged in a hole in the floor inside the room.

FIG. 18 depicts an installed device 10 that is positioned under a closed door 12 and seated on the floor 18. The installed device 10 has a reflective material 88 in a pattern installed on the angled outwardly facing surface 42 on the outer side 66 of the door. An outer reflective material 88 may signal to first responders that the door 12 has been secured and that the tenants of the room are safe. Thus, it may be an important tool for responders since it allows them to move onto unsecured rooms or to unsecured areas of a building. Other indicia, symbols, patterns, or material may alternatively be provided on the outer facing surface, such as the words "Locked Down" or other words.

Figure 19:
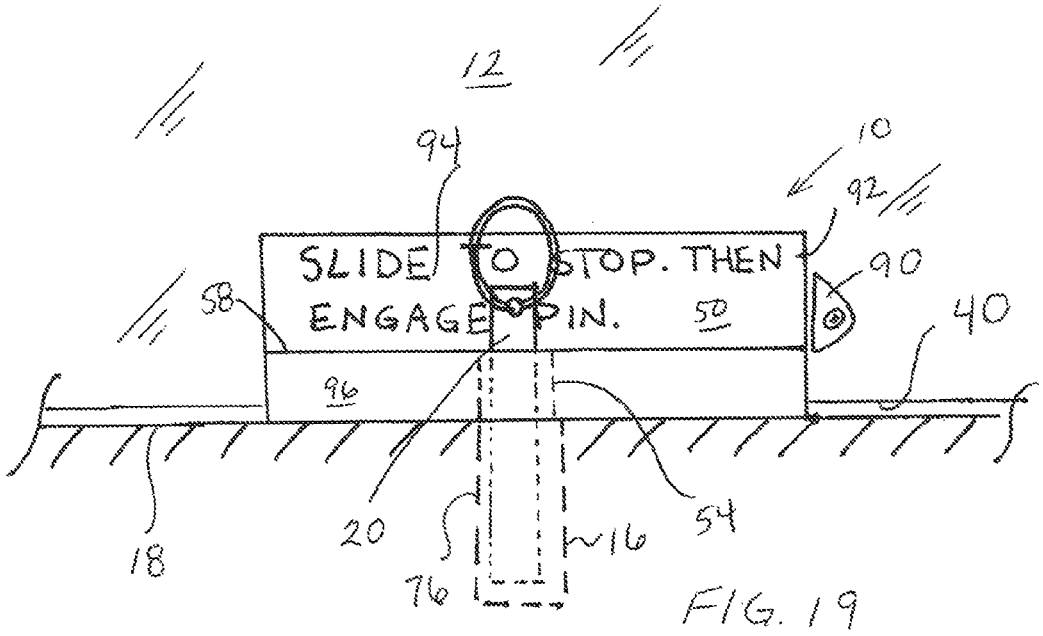
FIG. 19 is an inner view, e.g., from inside a classroom, of the device of FIG. 12 installed under a door with a pin engaged in a hole in the floor inside the room.

FIG. 19 depicts an installed device 10, like that in FIG. 18, but on the inside 68 of the door. In this view, the pin 30 is visible and is installed in the opening 76 in the floor 18. The device 10 is installed on the floor 18 under the door 12. The door 12 includes an alignment stop against which the device's side 92 rests. This stop 90 helps to align the barricade device 10 with the hole 76 in the floor 18 so that when the device 10 is positioned against the stop 90, the channel 54 in the fortified portion 36 will align with the hole 76 in the floor 18, making it easier to slide the pin 20 into the hole 76 in the floor 18. The angled inner side 50 of the device 10 is shown and may include indicia, patterns, or other matter to assist a user. For example, the device may provide installation instructions 94, like "Slide to stop. Then engage pin." Other instructions may be provided and installed on the surface 50, if desired. In addition, although not shown, instructions or other indicia may be positioned on the top surface 58 or forward facing surface 96 of the fortified portion 36.

Figure 20:
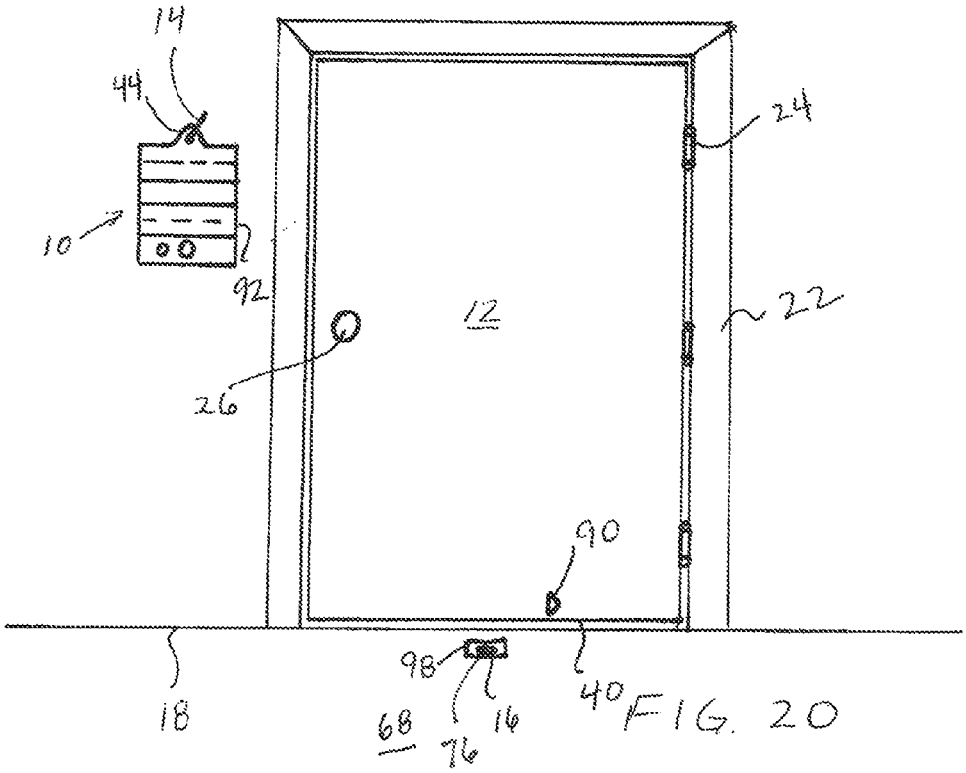
FIG. 20 is a view of a door from inside a classroom showing the example barricade device hanging on a hook on the wall in an uninstalled position.

FIGS. 20-23 depict the installation of the device on a single door 12. FIG. 20 shows the barricade device 10 being stored on a hook 14 on a wall that is next to the door 12 inside a room. The door 12 shown reflects the inside 68 of a door, and the outside 66 of the door is on the opposite side, which is not shown. The device 10 may be stored at other locations, as long as it is easily accessible in a time of need. A hook 14 may be used to store the device. Alternatively, clamps could be used to couple the device directly to the door (not shown). Other installation techniques and positions may be used. FIG. 20 also shows a stop 90 positioned on an inner side 68 of the door 12 near the bottom 40 center of the door 12. The stop 90 is used to help properly position the device 10 relative to the hole 76 in the floor 18. The stop 90 may be any type of stop, such as a rubber stop, and can be attached in any known manner, such as with a screw. Any type of stop may be used, including a plastic, rubber, or metal stop. A screw could serve as a stop, as could a thick washer that is applied to the door 12.

A hole 76 is positioned in the floor 18 for receiving the pin 20 of the device 10. The hole 76 in the floor 18 has a fixture 98 to support and cover the hole 76. A fixture 98 may be used to strengthen the hole 76, or to provide a larger opening in order to permit some leeway in positioning. In this case, a rectangular fixture is coupled to the floor 18 and an oval hole is positioned in the fixture 98. The hole 76 is shown positioned in the middle of the doorway opening, which will require the device to be installed in the middle of the door. Alternatively, the hole could be positioned closer to the door opening or closer to the hinges 24 of the doors. The location of the hole 76 may be a function of whether the door has windows in it or adjacent it. The intent is to position the barricade device 10 far enough away from any windows so that an intruder cannot have access to the device 10.

Figure 21:
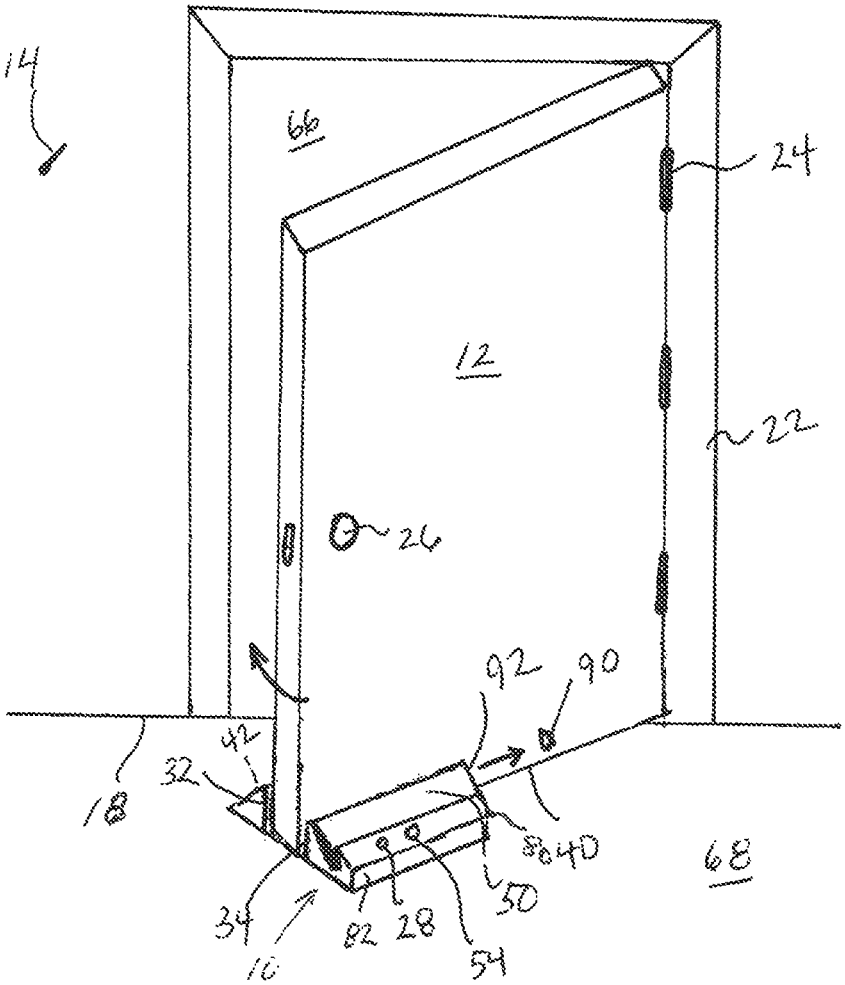
FIG. 21 is a view of an open door from inside a classroom with an example barricade device slid under the door and being slid toward an alignment stop on the door, indicating that the door closes outwardly and opens inwardly.

FIG. 21 shows the first step in installing the device 10 under a door 12. In this case, the door 12 opens inwardly. However, the installation steps are the same regardless of whether the door 12 opens inwardly, outwardly, or swings. The user first removes the device 10 from its storage location and opens the door 12. Then the user slides the recess portion 38 of the device 10 under the door 12 so that the upstanding members 32, 34 are positioned one on either side 66, 68 of the door 12. Then the device 10 is slid along the bottom 40 of the door 12 until it hits the stop 90 installed on the inner side 68 of the door 12. The device 10 should slide between the floor 18 and the bottom 40 of the door 12 along the recess 38. Once the device 10 hits the stop 90, the door 12 is closed. Then the pin 20 is pulled from its storage location and installed through the channel 54 in the fortified portion 36 and into the hole 76 in the floor 18.

As an alternative, once the device 10 is slid under the door 12, the door 12 may first be closed and then the device 10 can be slid until it abuts the stop 90, although it may be easier for a user to slide the device 10 to the stop 90 first. In addition, sliding the device 10 to the stop 90 first can also prevent the device 10 from interfering with the door frame 22 if it is not completely slid under the door 12.

Figure 22:
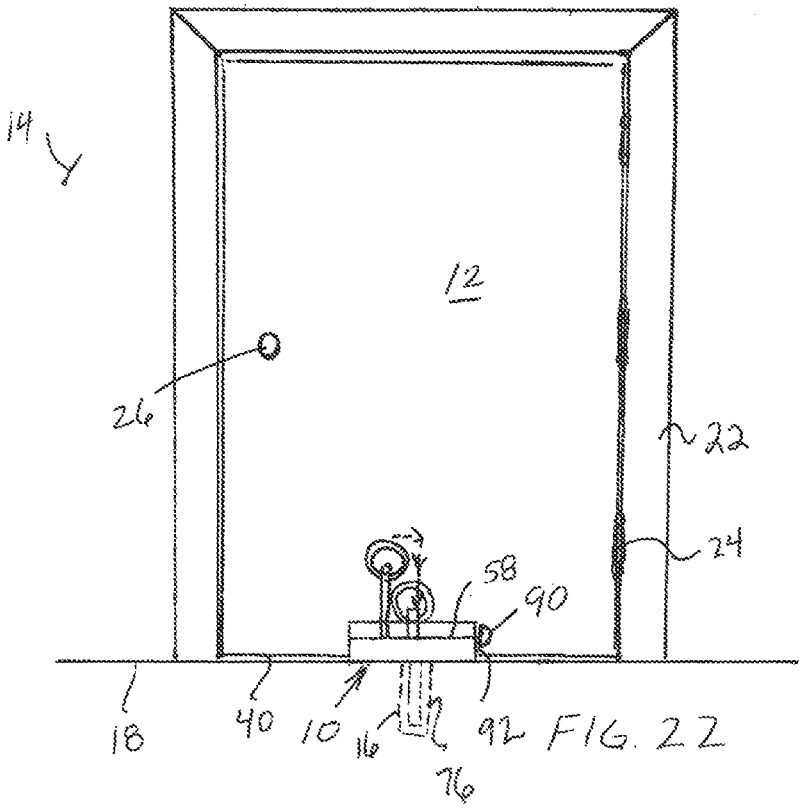
FIG. 22 is a view of a closed door from inside a classroom, with an example barricade device installed under the door and positioned against the alignment stop on the door, with the pin showing movement from a stowed positioned to an engaged position in a hole in the floor.
Figure 23:
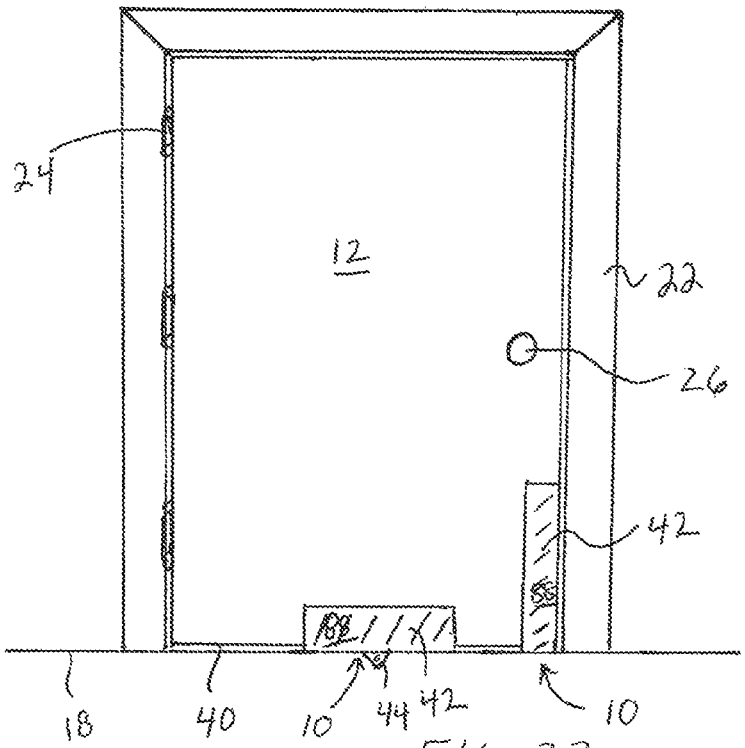
FIG. 23 is a view of a closed door from outside a classroom, with an example barricade device installed under the door, and also showing an alternative orientation for the example barricade device.

FIG. 22 shows the interior 68 of the door and the removal of the pin 20 from its storage location 28 on the fortified portion 36 and positioning of the pin 20 in the channel 54 of the fortified portion 36 and into the hole 76 in the floor 18. FIG. 23 shows the exterior 66 of the door 12, which may be present in a hallway, for example, of a school building. Two different embodiments are shown in FIG. 23, including a vertical embodiment I and a horizontal embodiment II. The horizontal embodiment II is the same as that shown in FIG. 22. The vertical embodiment I is an alternative embodiment that can be installed in a different location on the door, but that still utilizes the floor 18 to secure the device 10 relative to the door 12. Other locations may alternatively be used other than the floor 18 as long as they are not easily damaged, kicked in, or the like. For example, if a cinder block wall surrounds the door 12, the cinder block wall could be used as an anchoring point for the device, since it's not easily kicked in.

Figure 24:
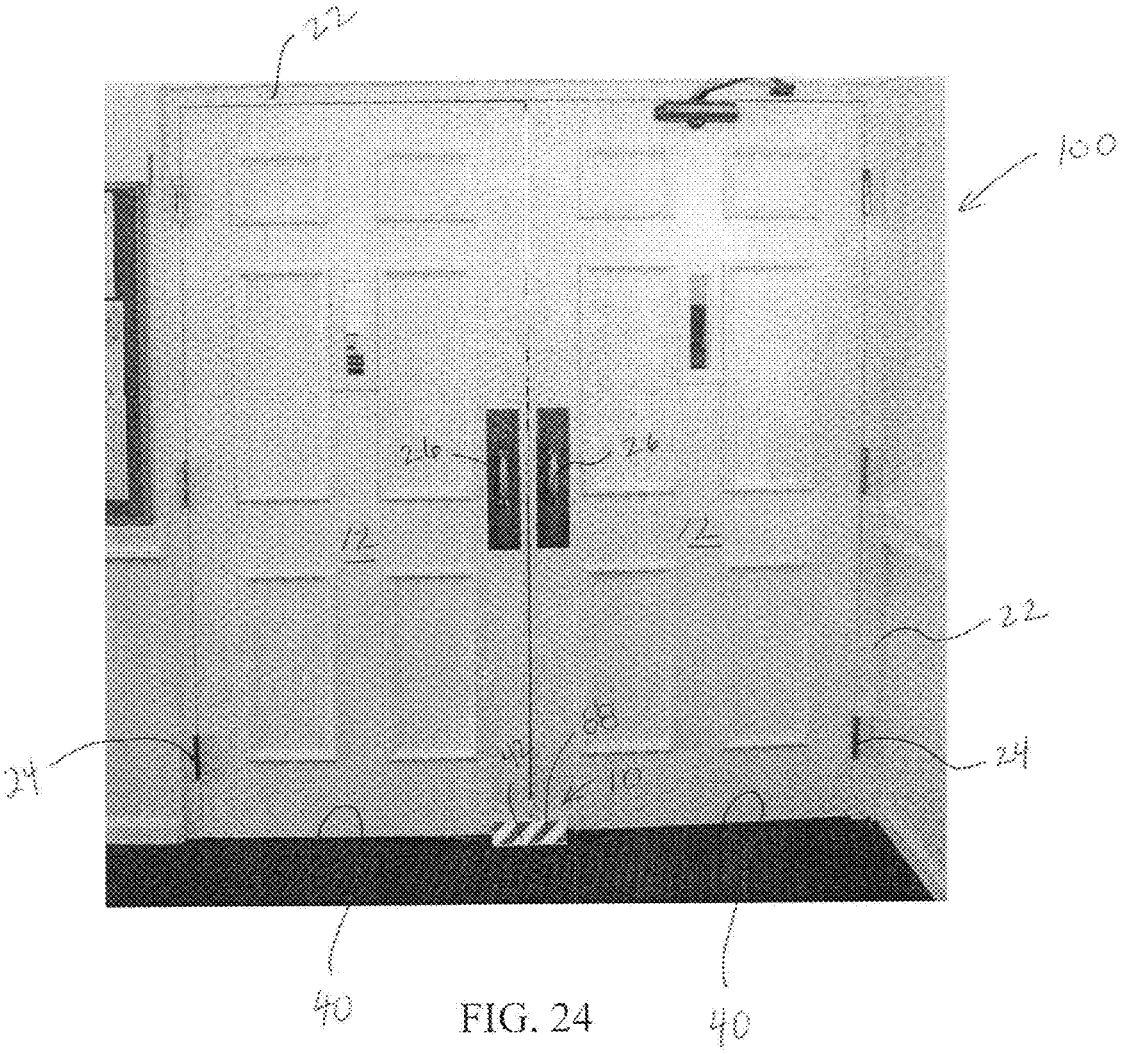
FIG. 24 is a view of a closed double door from outside a room, such as a chapel, with an example barricade device installed under both of the doors.

FIG. 24 shows installation of the device on a double door 100. In this example, the door 100 is a double door that does not have a lock or a door knob. The doors in this example only swing outwardly. The device 10 is installed in a manner similar to that described above in FIGS. 20-23, except for the device 10 is slid under both doors as the doors are simultaneously closed so that the bottom 40 of both doors 12 is captured within the recess 38 of the device 10. Then a pin 20 is installed in the device 10 into an opening 76 in the floor 18, as with the prior example. Instead of a single device, multiple devices could alternatively be used, one for each door. As is evident from FIG. 24, the angled reflective pattern 88 signals to responders that the door 12 is secured.

Figure 25:
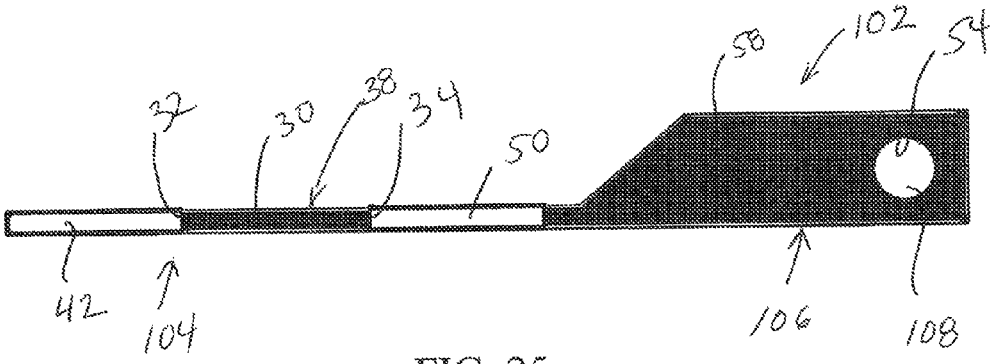
FIG. 25 is a top view of another alternative example barricade device.
Figure 26:
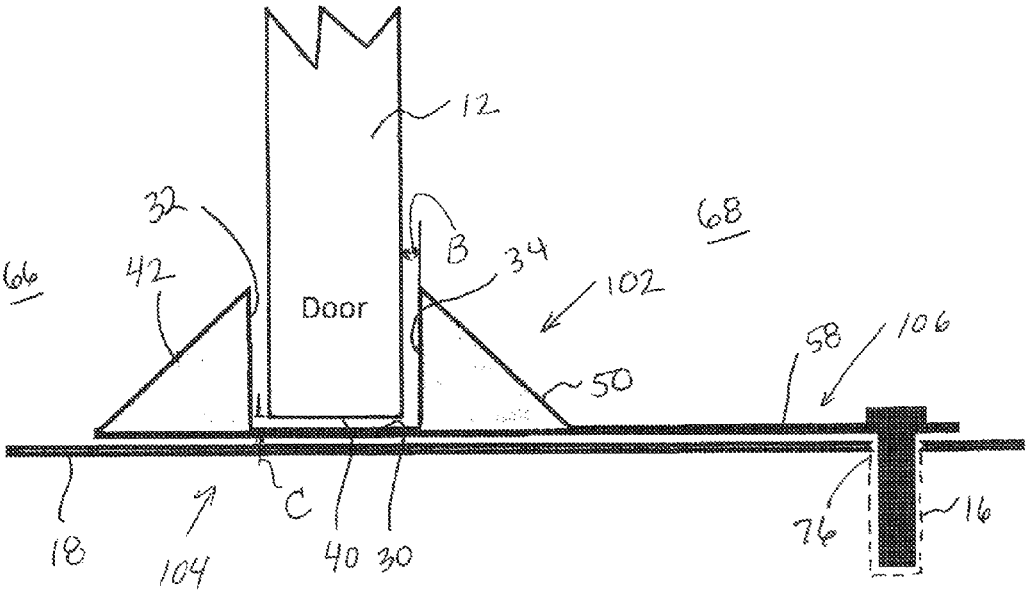
FIG. 26 is a cross-sectional side view of the alternative example barricade device of FIG. 25 installed under a door and with a pin engaged in a hole in the floor.

FIGS. 25 to 26 depict an alternative example barricade device 102 that is not as wide as the device 10 disclosed above. The device 102 is similar in that it attaches to the floor 18, but is narrow enough to be able to be slid under a door without opening the door 12 and then rotated upwardly such that the door 12 is positioned in the recess 38 defined between the two upwardly extending members 32, 34. The upwardly extending members 32, 34 in this case are triangular. The device has a bent L-shape, so that a first portion 104 of the device lies in a first plane and the second portion 106 of the device lies in a second plane that is substantially perpendicular to the first plane. The second portion 106 of the device 102 serves as the base of the device 10 and is the portion through which a pin 20 is inserted in order to couple the device 10 to a floor 18. Each of the first and second portions 104, 106 are planar, in the example shown. The first portion 104 includes the recess 38 that is positioned between the two upwardly extending members 32, 34. The first portion 104 is planar in order to slide under the door 12. The second portion 106 may be fortified, or may be planar. The second portion 106 has a hole 108 for receiving a pin 20. This example is advantageous in that it permits the device 102 to be installed without having to open the door 12. The user slides the planar portion under the door, rotates it upwardly 90 degrees until the upwardly extending members 32, 34 are positioned on opposite sides of the door 12, and then aligns the second portion 106 with the hole 76 in the floor 18 and installs a pin 20 into the hole 76. The pin 20 may be preapplied or may be stored and then applied after installation in this as well as the prior example. The pin 20 is inserted into the hole 76 in the floor to lock the barricading device 102 into position. This design has a slim profile in order to be able to slide under the door 12, be turned in place, and then a pin 20 or other securing mechanism can be inserted through the flange 106 into the floor 18. The hole 76 in the floor 18 is preferably pre-drilled and may have a casing 98 around the hole 76.

Figure 12:
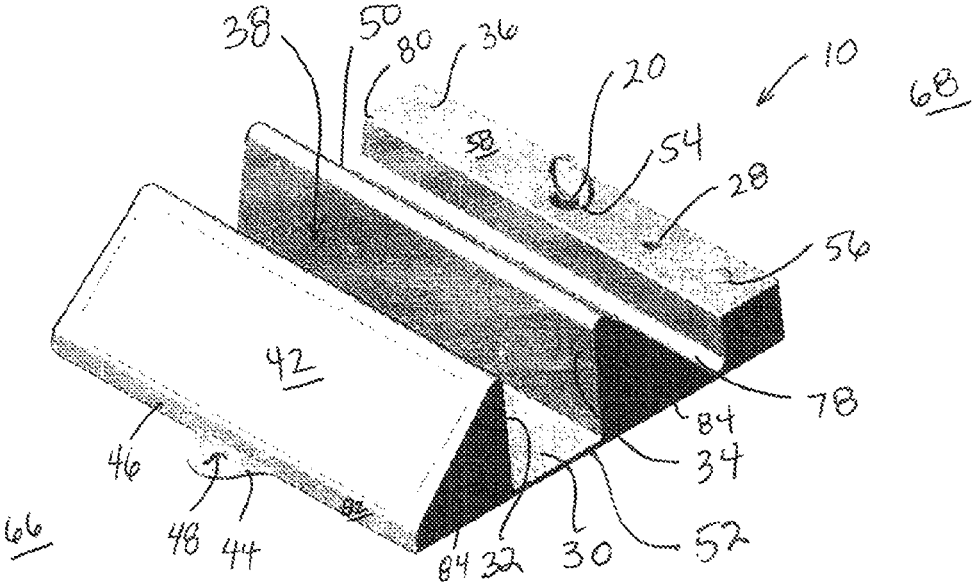
FIG. 12 is a perspective view of an alternative example barricade device showing a pin in an engaged position.
Figure 13:
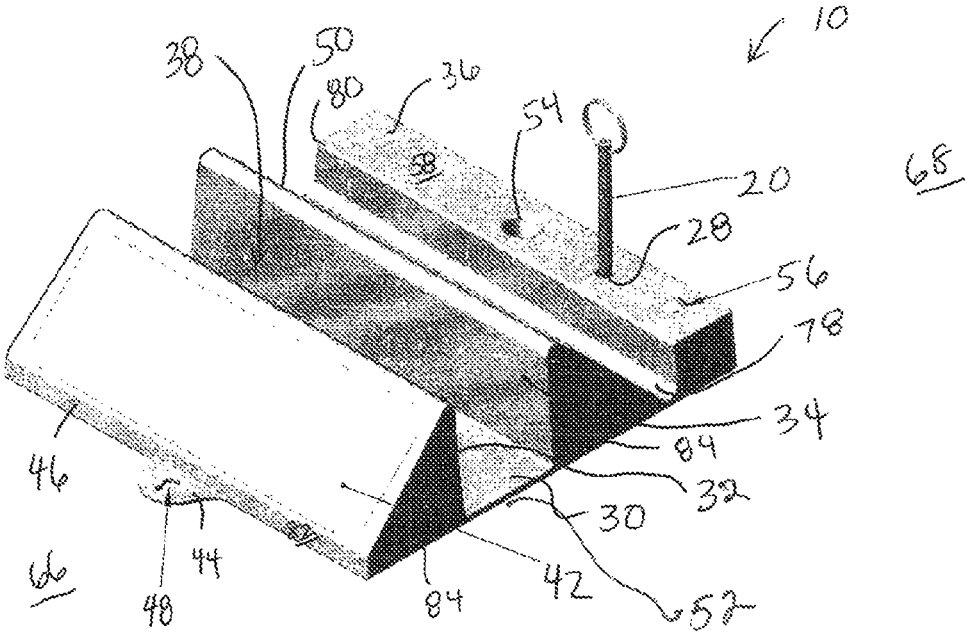
FIG. 13 is a perspective view of the example barricade device of FIG. 12 showing a pin in a stowed position.
Figure 14:
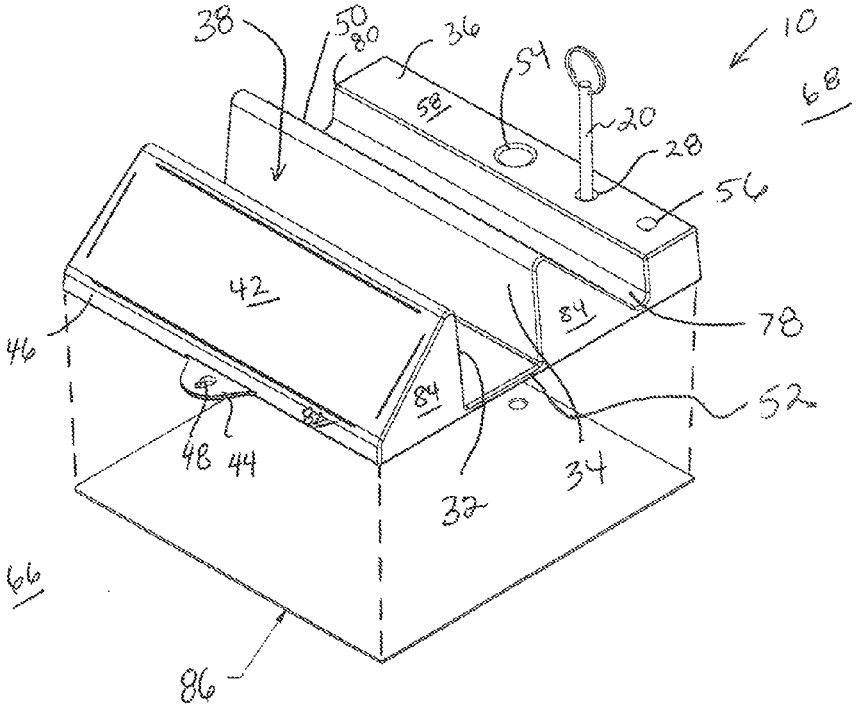
FIG. 14 is a perspective exploded view of the example barricade device of FIG. 13 with a base plate of the device shown separated from the top portion of the device.
Figure 15:
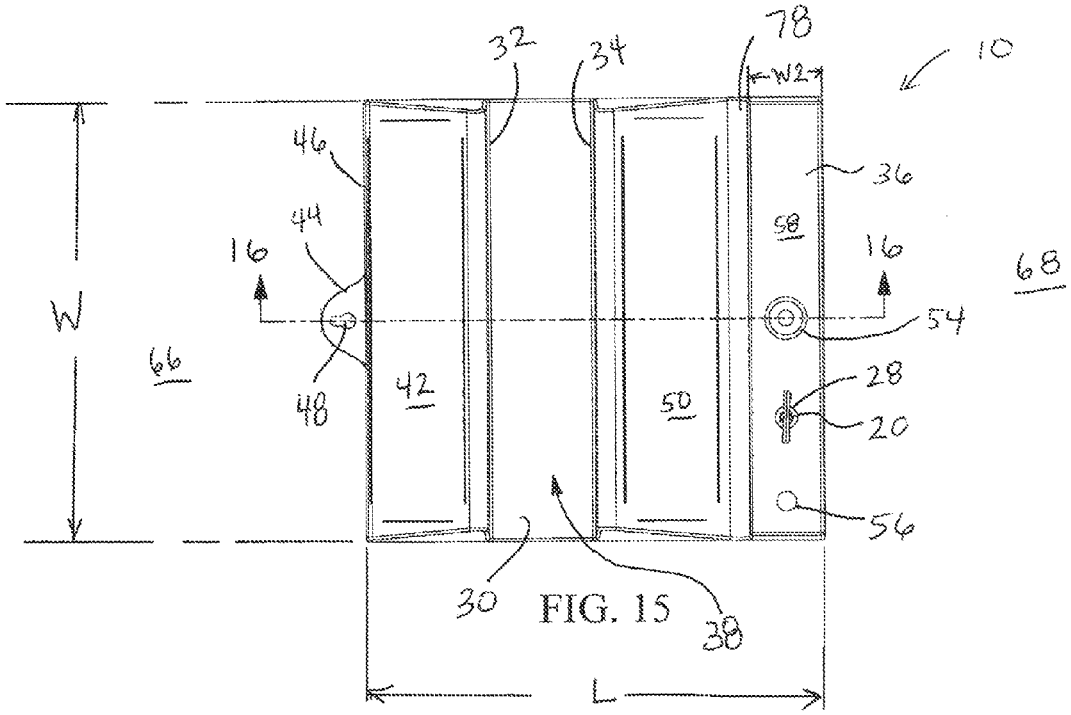
FIG. 15 is a top view of the example barricade device of FIG. 13.
Figure 16:
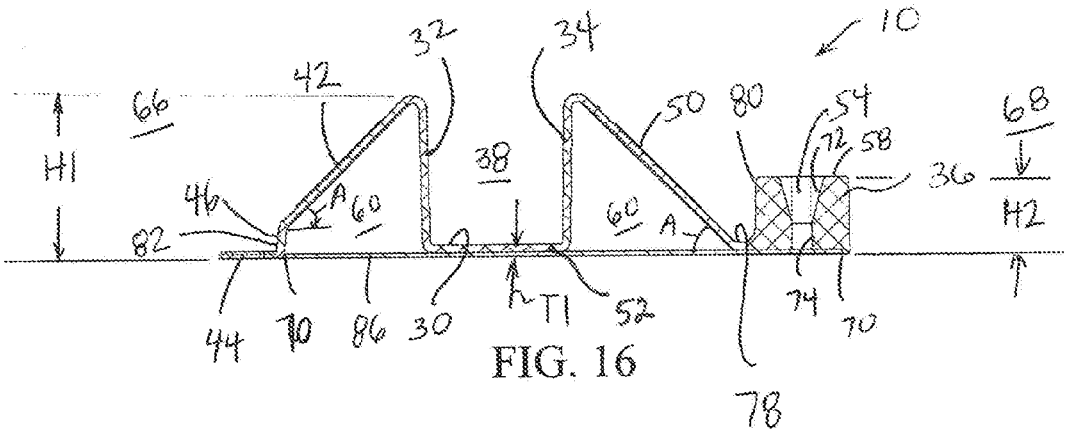
FIG. 16 is a cross-sectional view of the example barricade device of FIG. 13.
Figure 27:
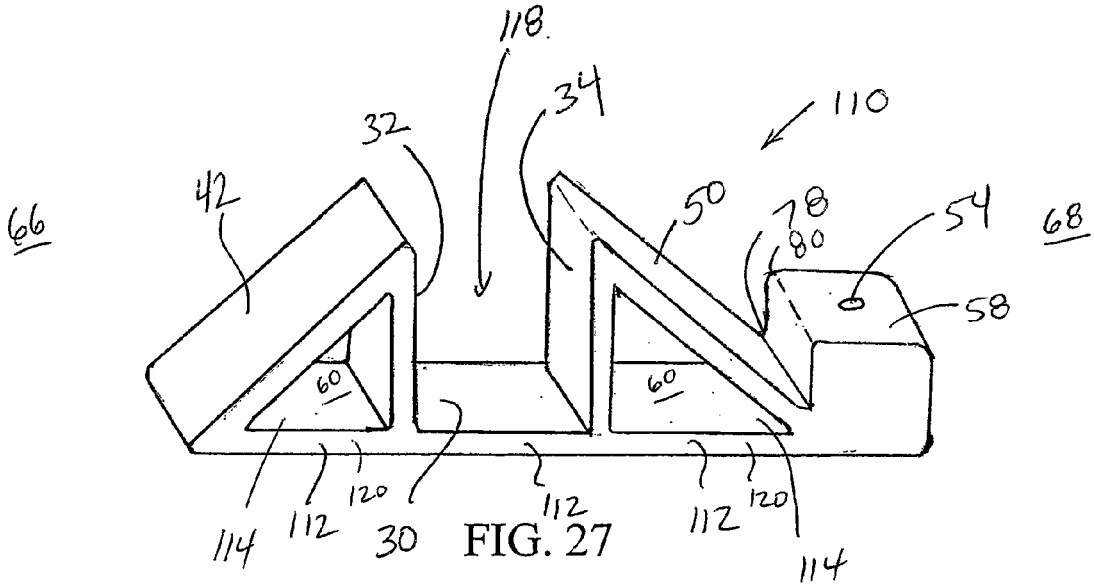
FIG. 27 is a perspective view of yet another alternative example barricade device.
Figure 28:
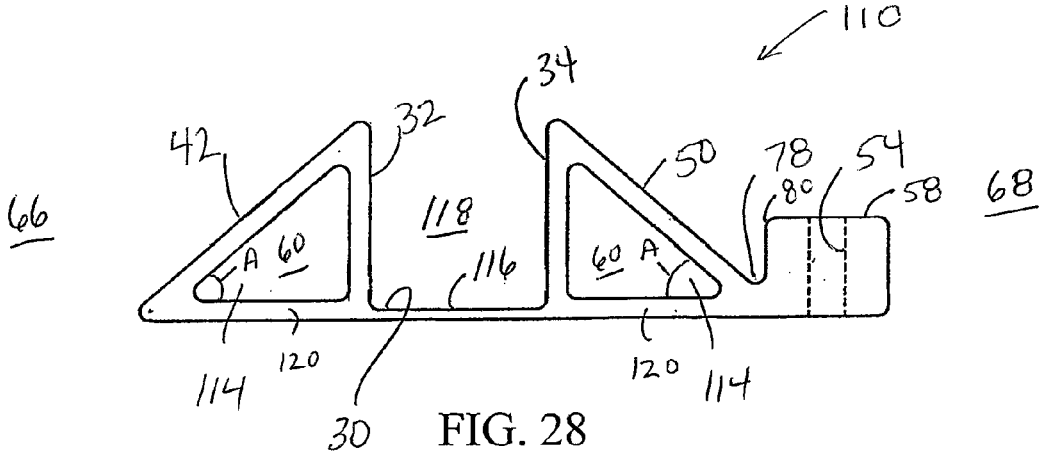
FIG. 28 is a side view of the example barricade device of FIG. 27.

FIGS. 27 to 28 depict an alternative example barricade device 110 that is similar to the device 10 previously shown in FIGS. 1 and 12, but having a base 112 that is integrally formed with the device 110 and openings 114 in the sides of the device 110 as finished. This device 110 may be more advantageously made of metal instead of plastic, but could be made of plastic. The base 116 of the recess 118 is thinner than the base 120 of the triangular portions. The fortified end portion 36 is made of a solid material. The base 116 inside the recess 118 may be made thinner, if necessary to fit under a door 12, or could be made thicker if a thinner area is not required. The channel 54 in the fortified portion 36 may be drilled or formed in any known manner. If desired, side plates (not shown) could be secured to the sides in order to enclose the recesses 118 within the triangular portions.

Figure 29:
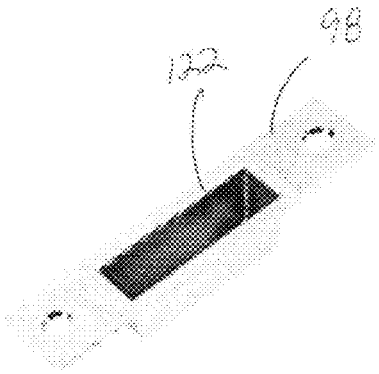
FIG. 29 is a perspective view of a fixture that may be positioned in a floor into which a pin of the example barricade device may be engaged.
Figure 30:
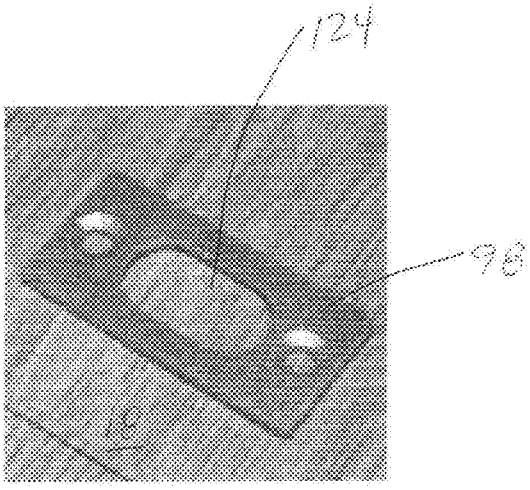
FIG. 30 is a perspective view of another fixture that may be positioned in or on a floor into which a pin of the example barricade device may be engaged.
Figure 31:
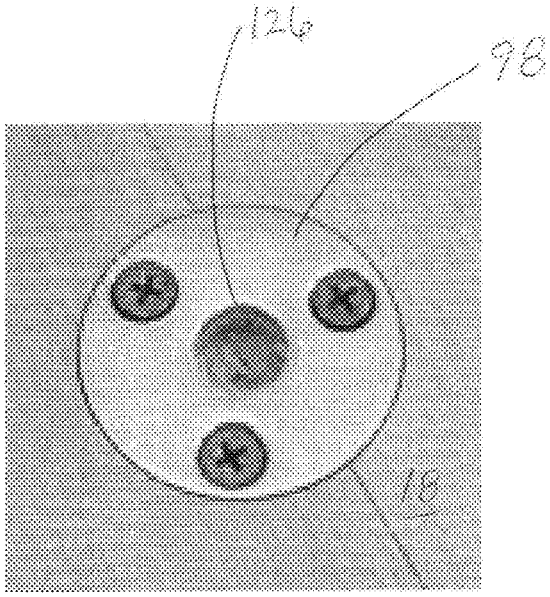
FIG. 31 is a perspective view of yet another fixture that may be positioned in or on a floor into which a pin of the example barricade device may be engaged.

FIGS. 29 to 31 show several different types of fixtures 98 that may be installed in or on a floor 18 in order to provide a recess into which the pin 20 may enter when the device 10, 102, 110 is installed. FIG. 29 is a rectangular recess that has an inner rectangular chamber 122 for receiving the pin 20. This device has a large rectangular opening and is installed such that the length of the device runs parallel to the inside surface 68 of the door 12 in a closed position. A smaller opening could be used. This device 98 may be installed with screws, for example (not shown). This device 98 is recessed into the floor 18 so that it does not pose a tripping hazard. The top surface of the device could either sit on the surface of the floor or be recessed into the floor so that the entire device is recessed below the surface of the floor 18.

The device 98 of FIG. 30 is similar to FIG. 29, but does not define a chamber under the upper surface of the device. This device 98 is a flat, rectangular plate that may be coupled to the floor 18 surface with screws (not shown). This device could be recessed into the floor 18, if desired, so that it does not pose a tripping hazard. The device 98 has a central oval opening 124 that can correspond to a hole 76 that is drilled in the floor 18. The hole 76 in the floor 18 does not have to be oval and can be smaller than the outline provided by the device 98, if necessary.

FIG. 31 is similar to FIG. 30 except the device 98 is round instead of rectangular and has a circular opening 126 into which a pin 20 can be inserted instead of a rectangular opening. This device 98 may be recessed into the floor 18 and the center opening 126 should be positioned over a hole 76 that is drilled in the floor 18. The device 98 may be coupled with three screws, as shown, or by another attachment technique. The opening 126 in the device 98 is preferably larger in diameter than the diameter of the pin 20.

The example device 10, 102, 110 does not have to have a fixture 98 that is attached to the floor 18. Instead, a hole or channel 76 could simply be drilled in the floor 18. The floor 18 may include other types of fixtures, if desired, such as a flush floor socket, a floor channel, a locator plate, an anchoring plate, a dust cover or protector, or any type of mounting surface that can be positioned in or on the floor 18. The example device 10, 102, 110 can work with any type of floor, including wood, tile, carpet, concrete, marble, and the like.

Figure 32:
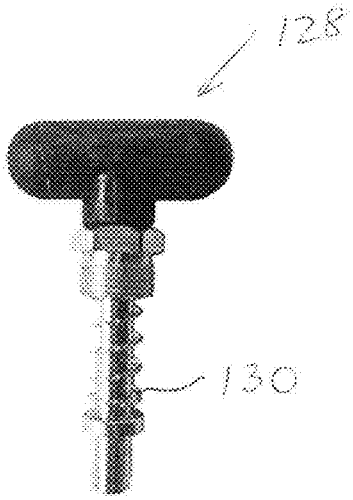
FIG. 32 is a side view of an alternative pin that may be used to secure the example device to a hole in the floor.

The pin 20 that was discussed in the prior examples was a straight cylindrical pin. The pin 20 shown in the figures had a ring positioned at the top of the pin 20 that could be used to remove the pin from an opening. Other types of pins may be used if desired. A pin could be preinstalled, if desired, so that it is only necessary to depress it instead of having to put the pin into a cylindrical recess. One type of pin that may be preinstalled and preloaded is a spring loaded pop pin 128, such as that shown in FIG. 32. This pin 128 may be locked in location by pressing downwardly and rotating the pin 128. As shown, a spring 130 may be utilized with the pin 128 and the spring 130 helps with insertion into the hole 76 and to maintain downward pressure to keep it in the hole 76. Other types of pins may alternatively be used. If a pin is not available, a nail, pen or similar device could be used in an emergency. However, it is highly recommended that a pre-approved pin be utilized to ensure that the pin has sufficient strength to withstand potential stresses from an intruder.

In another example, which is not shown, an example device is permanently attached to a door. The device may include a hinged anchoring arm that is rotated into position about the hinge. A metal piece may be attached to the bottom 40 of a door 12 but hinged in an upright position until needed. When needed, the hinged anchoring arm folds down and inserts into a floor socket to prevent the door from opening either inward of outward.

The example device uses the strength of the floor 18 and not the strength of the door frame 22, as with conventional locks. A door frame 22 can be smashed in, but it's difficult to move the door using the example device because it would be necessary to break the device 10 or the floor 18. Because of the design, there are fewer margins for error in deploying the example device 10. There is more amount of space that an intruder with a gun would need to shoot out to open the door. The example design is easy to use and easily removable once the crisis is over. For example, once the pin 20 is removed from the opening 76 in the floor 18, the device 10 can move with the door 12 to open and close the door 12, so that it doesn't actually need to be physically removed immediately.

The example device 10, 102, 110 may be made of aluminum, recycled aluminum, plastic, hard rubber, polycarbonate, resin, PVC, steel, copper, wood, stone/rock, manmade materials, synthetic materials, organic materials, poured concrete, Teflon, or other materials, as long as they can withstand a force applied to a door. The example device 10, 102, 110 may be made of a sheet of material, with the upwardly extending members 32, 34 being attached to the base member, such as by welding or gluing. Alternatively, the base member may be integrally formed, such as by molding, injection molding, or the like.

Possible dimensions for the device include a width W of about 9 inches, a length L of about 10 inches (including the tab), a recess 38 having a width RW of about 2⅛ inches, upwardly extending members having a height H1 of about 2.5-2.8 inches, a fortified portion having a height H2 of about 1¼ inches and a cross-sectional width W2 of about 1½ inches. The channel 54 in the fortified portion 36 has a cylindrical opening of about 0.3 inches in diameter. The base 30 in the recess 38 may have a thickness T1 of about ⅛ inches. In an alternative example, the base 30 may have a thickness T1 of about ⅕ to about ¼ inches. These dimensions may differ based upon the application or design chosen. For example, the length L of the base member could be varied to a shorter or longer length and the height H1 of the upwardly extending members could be changed, if desired.

The example device may have reflective qualities and include labels that are positioned on the angled surfaces 42, 50 that can be used to alert first responders that the device 10 has been deployed. This can be helpful in low light conditions. This also allows emergency personnel to concentrate their efforts on finding the intruder more quickly because they can bypass the doors that have the device installed. When the emergency personnel see that the example device has been installed, they can move on to other rooms or areas of the building.

The example device can be used for doors 12 throughout a building, including closets, bathrooms, utility rooms, classrooms, and offices, as shown below. The example device is quickly and easily installed by opening the door slightly and sliding the device into place. The device can be easily deployed with proper training in the case of an emergency, even by a properly trained child.

Installation of the device 10, 102, 110 involves a number of steps, including alignment of the stopper 90 and creation of a floor anchor hole 76. Alignment of the stopper 90 may be performed by first measuring ¾ inches up from the floor 18 and 12 inches over from the edge of the opening side of the door. The spot can be marked and this will serve as the location for the alignment stopper 90. The marked spot may be pre-drilled with a drill bit. Then the alignment stopper 90 may be attached to this location using a screw and a standard Phillips head screw driver.

The floor anchor hole 76 installation instructions are a function of the type of floor at issue. The following installation instructions cover floors without carpet and floors with carpet. In both cases, the example barricade device 10, 102, 110 is used to mark the proper location for the opening 76 in the floor 18.

In the case of a floor 18 without carpet, first the barricade device 10, 102, 110 is slid under the door 12 and the door is closed. Then the barricade device 10, 102, 110 is slid along the bottom 40 of the door 12 until it hits the alignment stopper 90. This represents the location of the device during use. The location of the channel 54 in the fortified end portion 36 is marked when the device 10, 102, 110 is in its installed position. Then the door 12 may be opened. A series of drill bits may be used to drill into the floor 18 to make a hole 76 large enough to serve as a floor anchoring hole. The anchoring hole 76 may be made any acceptable depth. One acceptable depth is 2 inches. After the anchoring hole 76 is finished, the example device 10, 102, 110 is ready to be deployed.

In the case of a floor 18 with carpet, first the example barricade device 10, 102, 110 is slid under a door 12 and the door is closed. Then the barricade device is slid along the bottom 40 of the door 12 until it touches the alignment stopper 90. Once the barricade is in position, the location of the channel 54 in the fortified end portion 38 is marked and the device 10, 102, 110 is removed and the door 12 is opened. Then a 1 inch by 1 inch hole is cut in the carpeting at the marked location and the carpet square is removed. The barricade device is again installed and slid under the door 12 until it hits the alignment stopper 90. Then the floor 18 under the carpet is marked at the location of the channel 54 in the fortified end portion 36 and the device is again removed and the door 12 is opened. Then the floor 18 is drilled using a series of drill bits and a hammer drill to make the floor anchor hole 76 sufficiently deep. Once the hole 76 has been drilled, the device 10, 102, 110 is ready to use.

While the above discussion is in the context of a classroom, it should be readily understood that the example device may be used with any type of building, including an office building, church, or other building that utilizes doors.

The term "non-door surface" is meant to describe any number of surfaces around a door, except for a door frame. This may include the walls and/or floors around a door. To the extent there are other surfaces around a door, other than the frame, that are not mentioned, the term "non-door surface" is also meant to encompass these other surfaces.

The term "substantially," if used herein, is a term of estimation.

While various features are presented above, it should be understood that the features may be used singly or in any combination thereof. Further, it should be understood that variations and modifications may occur to those skilled in the art to which the claimed examples pertain. The examples described herein are exemplary. The disclosure may enable those skilled in the art to make and use alternative designs having alternative elements that likewise correspond to the elements recited in the claims. The intended scope may thus include other examples that do not differ or that insubstantially differ from the literal language of the claims. The scope of the disclosure is accordingly defined as set forth in the appended claims.

What is claimed is:

1. A method for securing a door in a closed position during an emergency situation with a barricade, the barricade including a base member having a base portion for coupling to the door that includes a protruding portion extending from the base portion, wherein the protruding portion deters movement of the door from the closed position to an open position, and a securing mechanism for fixedly coupling the base member to a non-door surface when the door is in the closed position, said method comprising:

sliding the base member under the door when the door is in the open position such that the protruding portion of the base member abuts the door;

closing the door;

sliding the base member along the bottom of the door when the door is in the closed position until it abuts a stop that is positioned on the door in the vicinity of the bottom of the door; and pressing the securing mechanism through an opening in the base member until the securing mechanism enters an opening in the non-door surface.

2. The method of claim 1, wherein the non-door surface is a floor, and wherein the pressing step includes pressing the securing mechanism into and through the opening in the base member into the opening in the floor.

* * * * *